US006614230B2

(12) United States Patent
Raichle et al.

(10) Patent No.: US 6,614,230 B2
(45) Date of Patent: Sep. 2, 2003

(54) METHOD AND DEVICE FOR EVALUATING AN ION CURRENT SENSOR SIGNAL IN AN INTERNAL COMBUSTION ENGINE

(75) Inventors: Franz Raichle, Korntal-Muenchingen (DE); Joachim Berger, Winterbach (DE); Rainer Strohmaier, Stuttgart (DE); Wolfgang Fischer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 16 days.

(21) Appl. No.: 09/793,195

(22) Filed: Feb. 26, 2001

(65) Prior Publication Data

US 2002/0021120 A1 Feb. 21, 2002

(30) Foreign Application Priority Data

Feb. 24, 2000 (DE) ..... 100 08 553

(51) Int. Cl.[7] ..... F02P 17/00
(52) U.S. Cl. ..... 324/399; 73/35.08
(58) Field of Search ..... 324/388, 399; 123/406.47, 406.45, 491, 435; 73/116, 35.08, 35.04

(56) References Cited

U.S. PATENT DOCUMENTS 5,343,844 A * 9/1994 Fukui et al. ..... 123/481
5,396,176 A * 3/1995 Ishii et al. ..... 324/388
5,452,603 A 9/1995 Asano et al.
5,775,298 A * 7/1998 Haller ..... 123/425
5,778,855 A * 7/1998 Czekala et al. ..... 123/416
5,922,229 A * 7/1999 Kurano ..... 219/270
6,006,727 A 12/1999 Katashiba et al.
6,076,502 A * 6/2000 Katashiba et al. ..... 123/435
6,091,244 A * 7/2000 Rottler ..... 324/378
6,104,195 A * 8/2000 Yoshinaga et al. ..... 324/459
6,145,491 A * 11/2000 Wilstermann et al. . 123/406.35
6,275,041 B1 * 8/2001 Okamura et al. ..... 324/380
6,336,355 B1 * 1/2002 Sasaki et al. ..... 73/35.08

FOREIGN PATENT DOCUMENTS

| | | |
|---|---|---|
| DE | 197 55 247 | 6/1999 |
| EP | 0 190 206 | 8/1986 |
| FR | 2 765 275 | 12/1998 |

* cited by examiner

*Primary Examiner*—Safet Metjahic
*Assistant Examiner*—Etienne P LeRoux
(74) *Attorney, Agent, or Firm*—Kenyon & Kenyon

(57) ABSTRACT

A method and a device are described for evaluating a signal from an ionic current sensor of an internal combustion engine. Based on a signal from the ion current sensor, at least one quantity characterizing the combustion in the internal combustion engine is determined. At least one quantity characterizing a combustion start and/or a combustion quality is determined by conditioning the signal.

14 Claims, 3 Drawing Sheets

METHOD AND DEVICE FOR EVALUATING AN ION CURRENT SENSOR SIGNAL IN AN INTERNAL COMBUSTION ENGINE

FIELD OF THE INVENTION

The present invention relates to a method and a device for evaluating a signal from an ion current sensor of an internal combustion engine.

BACKGROUND INVENTION

In the related art, a plurality of parameters and states pertaining to the engine, such as combustion detection, combustion start, combustion center, and combustion quality, can be determined from the combustion-chamber pressure. In this context, the combustion-chamber pressure is recorded by a special, suitably mounted pressure sensor.

This method requires an additional bore hole in each cylinder head, as well as a pressure sensor suitable for mass-production.

An ion current soot sensor or an ion current sensor, which is used for the method according to the present invention, is likewise related art for diesel engines. In this context, it is possible to integrate the ion current sensor into the sheathed-element glow plug as well as into the injection nozzle.

From European Patent No. 0190206, a device for measuring and regulating the operating data of internal combustion engines is described, this device including an ion current sensor for specifically detecting pollutant components, such as soot, of an internal combustion engine. Furthermore, additional quantities necessary for the regulation of the internal combustion engine are determined by this ion current sensor.

SUMMARY OF THE INVENTION

An object of the present invention is to provide a method and system for measuring and influencing the operating data of an internal combustion engine in order to optimize the combustion process.

The core of the present invention is that a quantity that characterizes a combustion start and/or a quantity that characterizes a combustion quality is determined by conditioning the signal from the ion current sensor.

Due to the strong fluctuations in signal from the ion current sensor, an appropriate signal processing is crucial for extracting the parameters relevant to combustion. In this context, the manner in which the extraction of the parameters is communicated plays a critical role.

An advantage of the present invention is that the stated combustion features are available to the control unit, thereby achieving the desired combustion optimization. In this instance, in contrast to the method which employs a combustion chamber pressure sensor, no additional bore holes are necessary.

DETAILED DESCRIPTION

Figure 1:
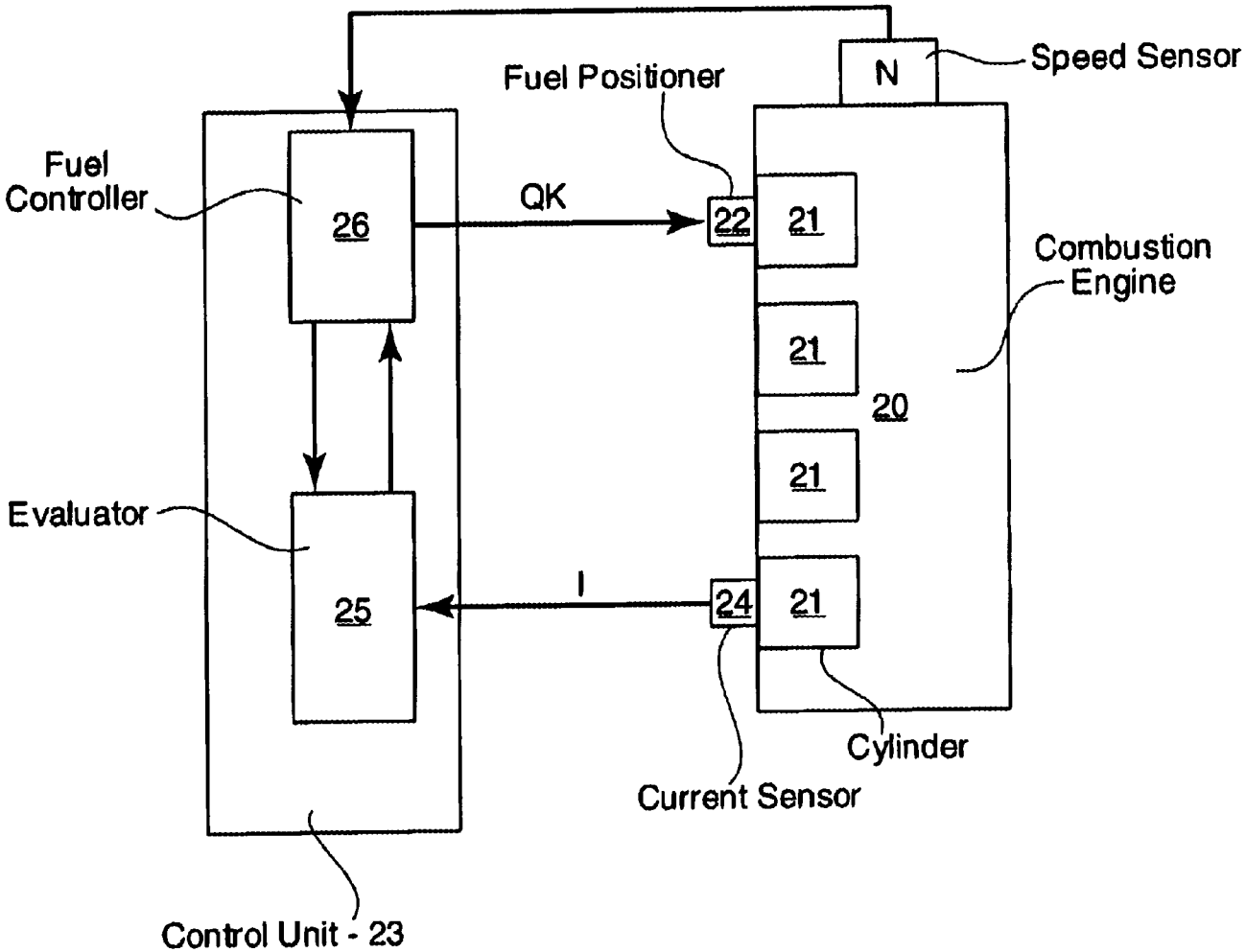
FIG. 1 shows a block diagram of the present invention.

In FIG. 1, reference numeral 20 indicates a multi-cylinder internal combustion engine. The cylinders are represented symbolically and are designated by reference numeral 21. The rotational speed of internal combustion engine 20 is determined by speed sensor N, preferably using an inductive sensor, or by a Hall element, a magnetoresistive sensor, or the like. The signal from speed sensor N is supplied to an electronic control unit 23 for controlling at least the fuel injection. Preferably, each cylinder 21 is assigned a fuel-quantity positioner 22, which is used to meter the fuel quantity preset by control unit 23. Injectors of a common-rail system, unit injector systems, distributor pumps, or other fuel-quantity positioners can be used as fuel-quantity positioner 22. Preferably, fuel-quantity positioners are used which provide for the quantity to be metered using the actuating time of solenoid valves or piezo-actuators.

Preferably, at least one cylinder is provided with an ion current sensor 24, whose signal is analyzed in an evaluator 25 of electronic control unit 23. Electronic control unit 23 includes a device 26 for controlling injected fuel quantity. Device 26 for controlling injected fuel quantity transmits different signals, such as different measurable quantities, e.g., rotational speed N, and internal quantities, e.g., the amount of fuel to be injected QK and the start of injection SB, to evaluator 25, where the quantities are processed, together with the signal(s) from the ion current sensor. The processing result is sent to device 26 for controlling injected fuel quantity. Based on these signals, device 26 for controlling injected fuel quantity selects the control signal for fuel-quantity positioner 22 of individual cylinders 21.

Figure 2:
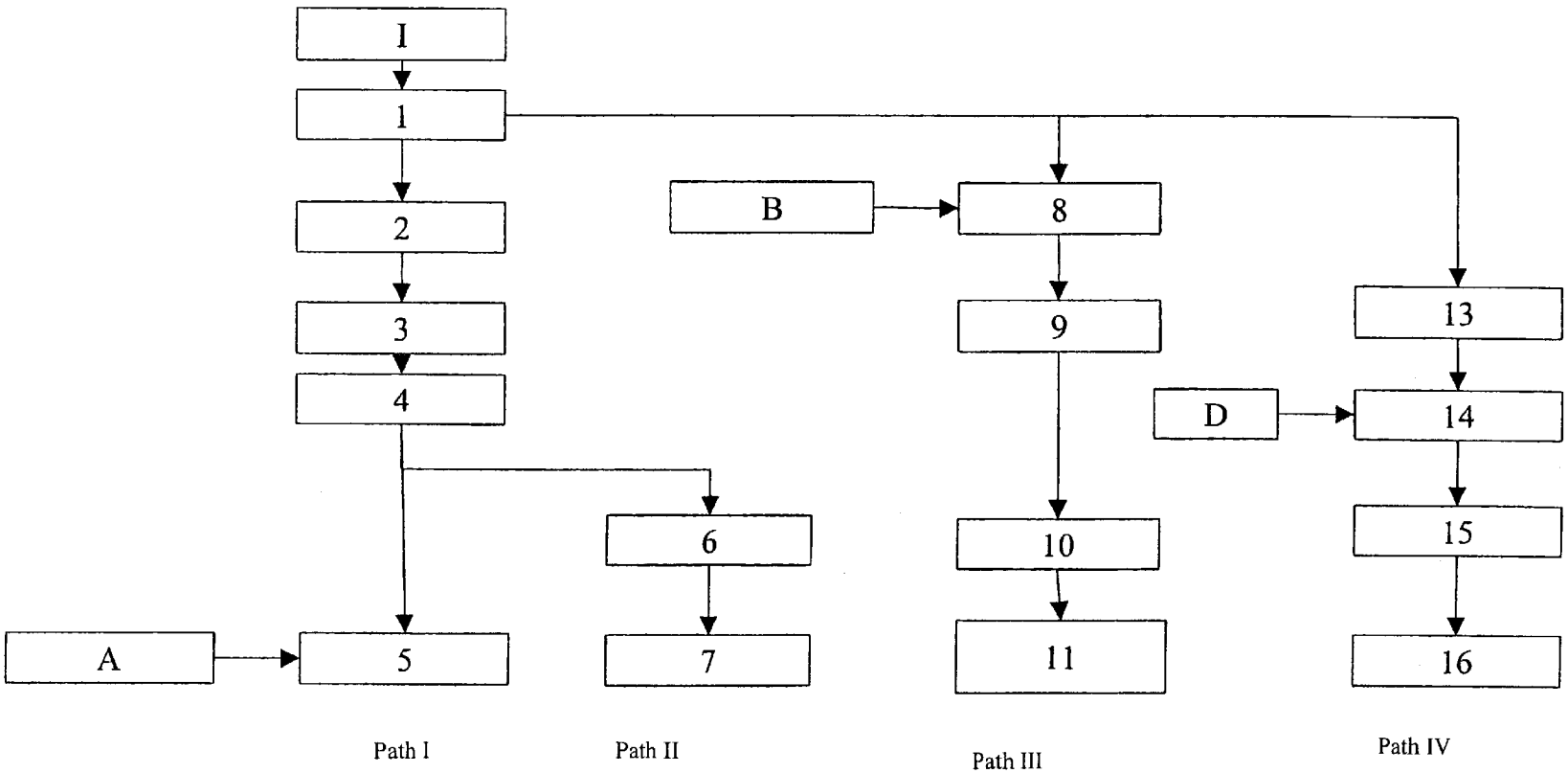
FIG. 2 shows a schematic flow chart for determining the operating data.

FIG. 2 illustrates one exemplary embodiment of the procedure according to the present invention. Based on the measured ion current signal I, the offset is corrected in step 1. As a result, fluctuations in the insulation resistance can be compensated for.

Preferably, the insulation resistance calculated from the offset stream is used for diagnostic purposes. Based on offset correction 1, in particular for small injected fuel quantities and thus for smaller ion current signals, a signal can be significantly improved by continuingly compensating for crankshaft-synchronous disturbances.

The ion current is simply composed of a first part, the offset stream, which is given by the electrical resistance of the electric circuit, and a second part, the actual useful information, which results from the combustion and the thus created charge carrier, and thereby causes the resistance of the electric circuit to change.

The first component, which can change over time, is calculated in a suitable crankshaft angle range and is subtracted for the evaluation (offset correction). The resistance (insulation resistance) belonging to the offset stream is calculated according to Ohm's law. If the insulation resistance is not within a certain range, an error is detected and appropriate measures are introduced.

In addition to these two components, there can be additional disturbance components, which suitable measures, such as filtration, can compensate for.

In FIG. 2, a combustion detection is illustrated as path I. In a step 2, a bandpass filtering is carried out, and in subsequent step 3, an absolute value is generated. In this manner, disturbances can be eliminated. Subsequently, in step 4, signal I is integrated over an appropriate crankshaft angle range, thereby resulting in an energy quantity.

In a step 5, this energy quantity is compared to a first threshold value stored in a characteristics map A. If the energy quantity exceeds threshold value A, a completed combustion is detected. The threshold value used results from a characteristics map A as a function of the instantaneous operating point, which is preferably defined by the load and rotational speed of the internal combustion engine.

For rugged combustion detection, the evaluation of combustion detection of a suitable number of subsequent individual working cycles is advantageous.

Preferably, the values of the energy quantity are averaged over a plurality of combustion processes and subsequently compared to the threshold value. Alternatively, it can also be provided that the device detects combustion when the threshold value is exceeded several times.

The integration of the pre-processed ion current signal only occurs in a predefined crankshaft angle range, which is preferably the angular range in which combustion is taking place.

For detecting combustion, the thus determined integrator value is compared to a threshold value, which is stored in a characteristics map, e.g., as a function of load and rotational speed. If the integrator value is above the threshold, combustion has occurred. If the opposite is true, no combustion has taken place.

In accordance with the present invention, the ion current sensor's signal is integrated and compared to a threshold value, to detect a completed combustion. In this context, the signal that has undergone offset correction is preferably used.

By evaluating the ion current sensor's signal, a quantity characterizing a combustion quality is determined. In this context, it is particularly detected whether combustion has taken place.

The detailed detection of the combustion quality occurs based on the output signal ascertained in step 4. In step 6, the integrated signal is averaged. The variance is also determined in step 6. This is preferably carried out over the course of a plurality of working cycles.

The variance and/or average value are used to assess the combustion quality. The assessment occurs in step 7. The combustion quality is indicated, for example by comparing it to a reference characteristics map, as a function of the operating point (load, rotational speed).

The combustion quality is assessed by evaluating the integrated measurands of a plurality of combustion processes. For this purpose, two characteristic values are calculated. The average value indicates the average of the integrated measurands of the combustion processes in question. The variance indicates how strongly the integrated measurands in question fluctuate. Information regarding the combustion quality is obtained by comparing these two values to the values in a previously applied characteristics map. To assure a good combustion quality, the average value is to exceed a certain value, and the variance is not to become too large.

In accordance with the present invention, the signal from the ion current sensor is integrated and averaged to determine a quantity characterizing the combustion quality. In this context, the signal that has undergone the offset correction is preferably used. Preferably, the average value and the variance are used as a quantity which characterizes the combustion quality.

The determination of the combustion start is illustrated in FIG. 2 by path III. In step 8, in an appropriate crankshaft angle range, the ion current signal, which has undergone an offset correction, is compared to a threshold value. The threshold value is stored in a characteristics map 3 as a function of the operating point (load, rotational speed). In step 9, the angular position at which the signal exceeds the threshold value is recognized as the combustion start.

The start of combustion can also be determined using parametric procedures.

The result of the combustion-start detection is checked for plausibility in step 10. The combustion detection, combustion quality, and the values of a characteristics map C are tested. Limits for a plausible combustion start are stored in characteristics map C as a function of the operating point (load, rotational speed). If a plausible combustion start 10 is present, this combustion start is considered in step 11 in a subsequent average. The averaging in step 11 results from a suitable number of working cycles. The averaging is preferably carried out as a sliding averaging. An averaging is necessary due to the fluctuations in the combustion processes and in the ion current signals. This thus determined combustion start can be used as the actual value of the combustion start in controlling the internal combustion engine. In particular, this value can be used as the actual value of a combustion-start control. Such a combustion-start control can supplement or completely replace the start-of-injection control.

The combustion start is determined in an appropriate crankshaft angle range, i.e., in a range in which the start of combustion can occur. The instant or the crankshaft angle at which the ion current exceeds a predefined value is accepted as the combustion start. Since the ion current is subject to strong fluctuations in some instances, the thus determined values of the combustion start of the individual combustion processes are averaged over an appropriate number of combustion processes. Only the values of the combustion start of the individual combustion processes, which are within a plausible range, are used for the averaging. The plausible range results from the fact that for a fixed start of injection, the combustion start can only be within a certain window after the start of injection. Instead of using a threshold to detect the start of combustion, a parametric method can also be used for this purpose. Parametric methods are mathematical methods of calculation which utilize information regarding the form of the ion current signals, for example, in this instance, to better calculate the combustion start. That is to say that a model for the ion current is present, and only the few parameters of the model remain to be determined.

In accordance with the present invention, the signal from the ion current sensor is compared to a threshold value to detect the combustion start. In this context, the signal that has undergone the offset correction is preferably used.

The determination of the combustion center is illustrated in FIG. 2 in path IV. After the offset of the ion current signal is corrected in step 1, the center of gravity of an area is calculated in step 13 within a crankshaft angle range suitable for the evaluation. In step 14, this result also undergoes a plausibility test. This test is carried out on the basis of the combustion quality, combustion detection, and a value of a characteristics map D. Limits for a plausible center of gravity of an area are predefined in characteristics map D as a function of the operating point (load, speed). In the event of a plausible result, the instantaneous center of gravity of an area is taken into account in the subsequent averaging in step 15. The averaging in step 15 results from an appropriate number of working cycles and is preferably generated as a sliding average.

An averaging is necessary due to the fluctuations in the combustion processes and of the ion current signals. Since the center of gravity of an area derived from the ion current has a constant displacement with respect to the combustion center derived from the pressure as a function of the operating point, a correction can be provided in step 16 with the aid of a characteristics map.

The combustion center is preferably used as an actual value for regulating the combustion state. Furthermore, the combustion center can be used as an operating parameter for controlling and/or regulating other manipulated variables. Thus, for example, the start of injection can be taken into account.

Instead of the center of gravity, other quantities, such as the center of area, can also be calculated. In this context, the center of area represents a certain crankshaft angle having the characteristic that areas of the ion current signal to the left and right of this position are equal.

The center of gravity of an area is calculated using a usual formula. This calculation results in a value of the angular position of the crankshaft or the camshaft for the area center of gravity.

Since the ion current signal can vary greatly, the result of the area center of gravity of every combustion is checked for plausibility. This is done using a characteristics map in which limits for the start and end of the area center or gravity are indicated as a function of the operating state. If the instantaneously calculated area center of gravity is outside of the limits, this value is not used in the subsequent averaging. The subsequent averaging generates a stable area center of gravity, the averaging length resulting as a compromise from the requirement for a quick adaptation to the changes in the operating point and from the desired stability of the area center of gravity. A correction follows which is dependent on the operating point and includes a characteristics map for generating a value which corresponds to the combustion center of the pressure, and thus, can be used for a closed-loop control.

One refinement of the present invention provides for an averaging for detecting the combustion start and the combustion center to take place in path III and path IV, already after the offset correction. In this context, the averaging results from the processed time signals of the ion current. In this instance, only the combustion processes containing sufficient data are used for averaging.

Figure 3:
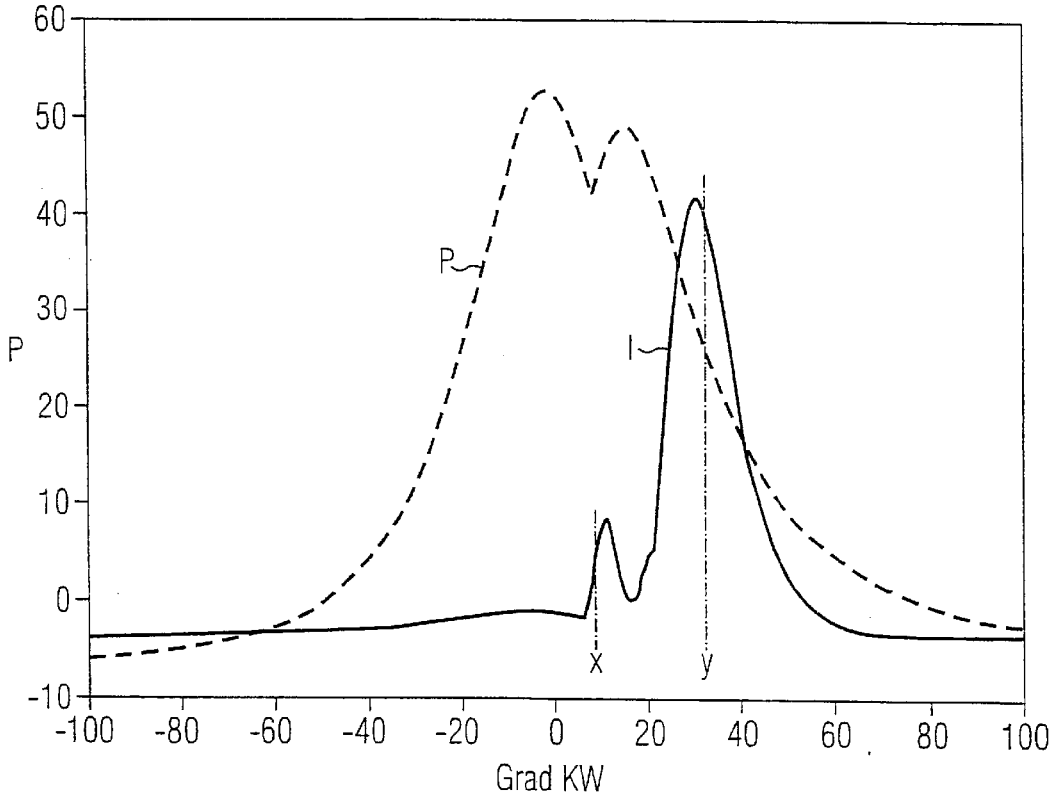
FIG. 3 shows a diagram of the signal from the ion current sensor and of the signal from the combustion chamber pressure sensor.

In accordance with the method according to the present invention and the system according to the present invention, the detection of the combustion start and the combustion center is exemplarily represented in FIG. 3. The combustion center is generated from the ion current's area center of gravity by correction, using a characteristics map 16 which is dependent on the operating point.

Dotted line P in FIG. 3 illustrates the pressure characteristic in the cylinder, and solid line I illustrates the ion current sensor's signal plotted over the crankshaft angle (degree KW). In addition, combustion start X and area center of gravity Y are marked by vertical, dot-dash lines.

Before reaching top dead center, the pressure characteristic has a maximum of 0 degrees, then dips at top dead center, and then climbs to a second, lower maximum. The ion current sensor's signal has a first small peak at about the dip in the pressure characteristic and a maximum after the top dead center at about a 30° crankshaft revolution.

In this context, it is particularly advantageous that the determined quantities, such as the combustion start, the quantity characterizing the completed combustion, and/or the combustion quality, is tested for plausibility (10) by comparing them to threshold values.

The threshold values to which the quantities are compared in order to determine the quantities and/or to detect plausibility are preferably specifiable as a function of the instantaneous operating point, in particular of load and speed.

To simplify the signal processing, the evaluation preferably occurs only within one angular range. This angular range of the crankshaft or of the camshaft corresponds to the angular range in which the combustion will probably take place.

A more reliable determination of the quantities results from an averaging of a plurality of working cycles, i.e., a plurality of combustion cycles. Preferably a sliding averaging is carried out.

What is claimed is:

1. A method for evaluating a signal from an ion current sensor of an internal combustion engine, comprising the steps of:

determining at least one quantity characterizing at least one of a combustion start and a combustion quality in the internal combustion engine based on the signal from the ion current sensor, wherein the at least one quantity is determined by conditioning the signal from the ion current sensor; and detecting a completed combustion by performing the steps of:

integrating the signal from the ion current sensor, and subsequently comparing the integrated signal to a first threshold value, wherein if the integrated signal exceeds the first threshold value, the completed combustion is detected.

2. The method according to claim 1, further comprising the step of:

performing an offset correction on the signal from the ion current sensor.

3. The method according to claim 2, further comprising the step of:

performing a diagnostic operation based on the offset correction and on a calculable insulation resistance.

4. The method according to claim 1, further comprising the step of:

determining the combustion quality based on the integrated signal from the ion current sensor.

5. The method according to claim 4, wherein the step of determining the combustion quality includes the step of:

comparing at least one of an average value and a variance of the integrated signal from the ion current sensor to a second threshold value.

6. The method according to claim 1, further comprising the step of:

detecting the combustion start by comparing the integrated signal to a third threshold value.

7. The method according to claim 1, further comprising the step of:

checking the determined at least one quantity for plausibility by comparing the determined at least one quantity to a fourth threshold value.

8. The method according to claim 7, wherein:

the respective threshold value is specifiable as a function of an instantaneous operating point.

9. The method according to claim 8, wherein:

the instantaneous operating point corresponds to a load and a speed.

10. The method according to claim 1, wherein the combustion is determined only within one angular range.

11. The method according to claim 1, further comprising the step of:

averaging the at least one quantity over a plurality of working cycles.

12. The method according to claim 11, wherein:

the step of averaging is performed in accordance with a sliding averaging.

13. The method according to claim 1, further comprising the step of:

performing at least one of a controlling and a regulating of an actuator of the internal combustion engine in accordance with the at least one quantity.

14. A device for evaluating a signal from an ion current sensor of an internal combustion engine, comprising:

an arrangement for determining at least one quantity characterizing at least one of a combustion start and a combustion quality in the internal combustion engine based on the signal from the ion current sensor, wherein the arrangement includes:

an arrangement for determining the at least one quantity by conditioning the signal from the ion current sensor; and an arrangement for detecting a combustion event by integrating the signal from the ion current sensor, and subsequently comparing the integrated signal to a threshold value, wherein if the integrated signal exceeds the threshold value, the combustion event is detected.

* * * * *